US009402453B2

(12) United States Patent
Yan

(10) Patent No.: US 9,402,453 B2
(45) Date of Patent: Aug. 2, 2016

(54) MOBILE DEVICE TRANSMISSION APPARATUS WITH INTEGRATED TOOL

(71) Applicant: Kelvin Yan, Brea, CA (US)

(72) Inventor: Kelvin Yan, Brea, CA (US)

(73) Assignee: KANEX, Brea, CA (US)

( * ) Notice: Subject to any disclaimer, the term of this patent is extended or adjusted under 35 U.S.C. 154(b) by 0 days.

(21) Appl. No.: 14/482,683

(22) Filed: Sep. 10, 2014

(65) Prior Publication Data

US 2015/0162712 A1 Jun. 11, 2015

Related U.S. Application Data

(60) Provisional application No. 61/913,841, filed on Dec. 9, 2013.

(51) Int. Cl.

| | |
|---|---|
| ***H01R 13/72*** | (2006.01) |
| ***B67B 7/16*** | (2006.01) |
| ***A45C 11/18*** | (2006.01) |
| ***A44B 15/00*** | (2006.01) |
| ***A45C 11/32*** | (2006.01) |

(52) U.S. Cl.

CPC ..... *A45C 11/18* (2013.01); *A44B 15/005* (2013.01); *A45C 11/321* (2013.01); *B67B 7/16* (2013.01)

(58) Field of Classification Search

CPC ..... H01R 13/72; B67B 7/16; A44B 15/00; A45C 11/18

See application file for complete search history.

(56) References Cited

U.S. PATENT DOCUMENTS

| | | | |
|---|---|---|---|
| 6,733,328 | B2 | 5/2004 | Lin et al. |
| 7,136,288 | B2 | 11/2006 | Hoogerdijk |
| 7,841,903 | B2 | 11/2010 | Saito |
| 8,491,330 | B2 | 7/2013 | McSweyn |
| 8,758,045 | B2 | 6/2014 | McSweyn |
| 2008/0143290 | A1 | 6/2008 | Chavakula |
| 2010/0315752 | A1 | 12/2010 | Rabu et al. |

*Primary Examiner* — Briggitte R Hammond

(74) *Attorney, Agent, or Firm* — Jafari Law Group, Inc.

(57) ABSTRACT

The invention generally relates to an apparatus for facilitating power transmission to and synchronization of a mobile device, which includes at least one integrated tool. For example, the integrated tool may be one or more of: a key-chain, a bottle opener, a writing implement, a business card holder, or other useful tools that may be integrated with a communication medium that enables the transmission and/or synchronization of mobile devices.

7 Claims, 10 Drawing Sheets

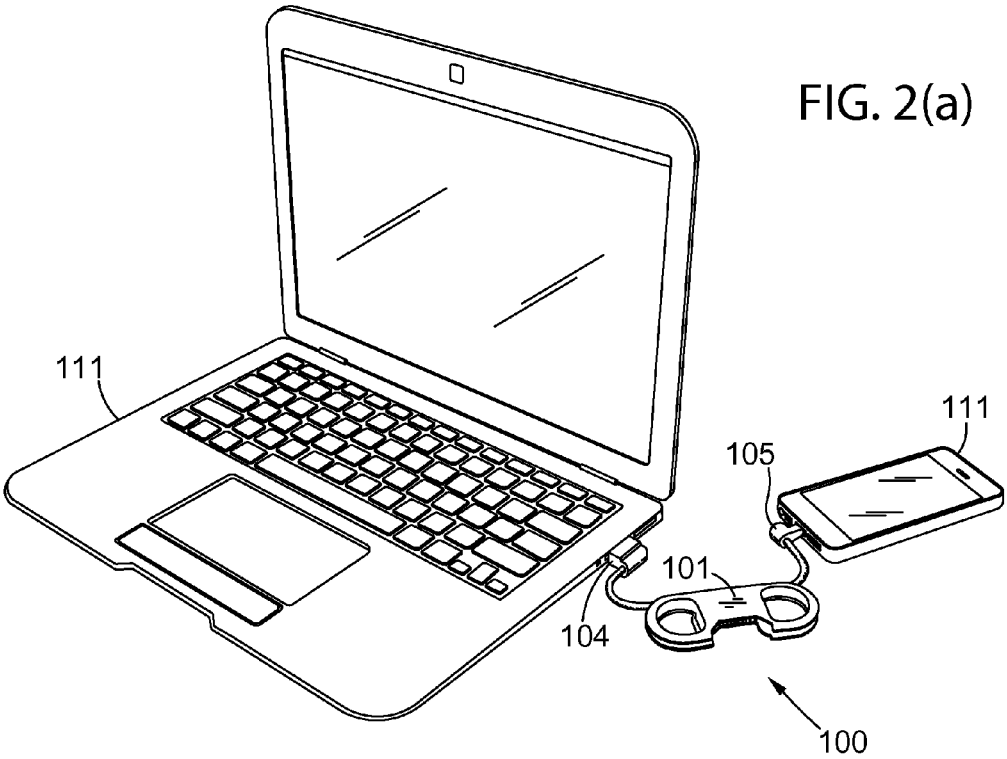
FIG. 2(a)
FIG. 2(b)
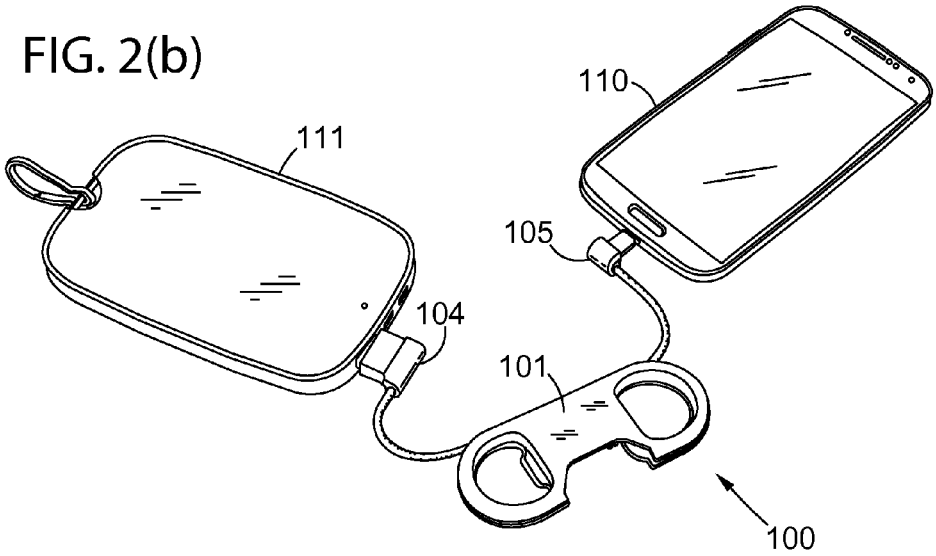

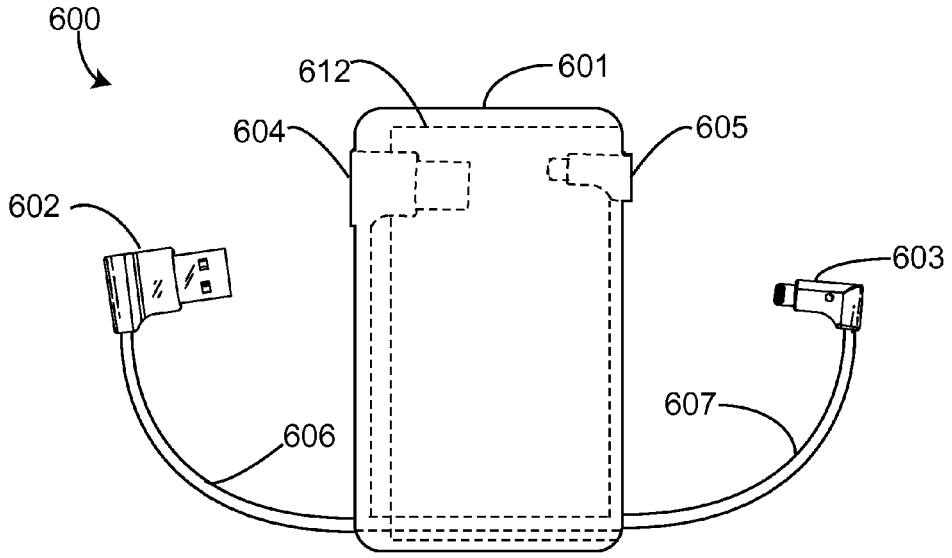
FIG. 6(a)
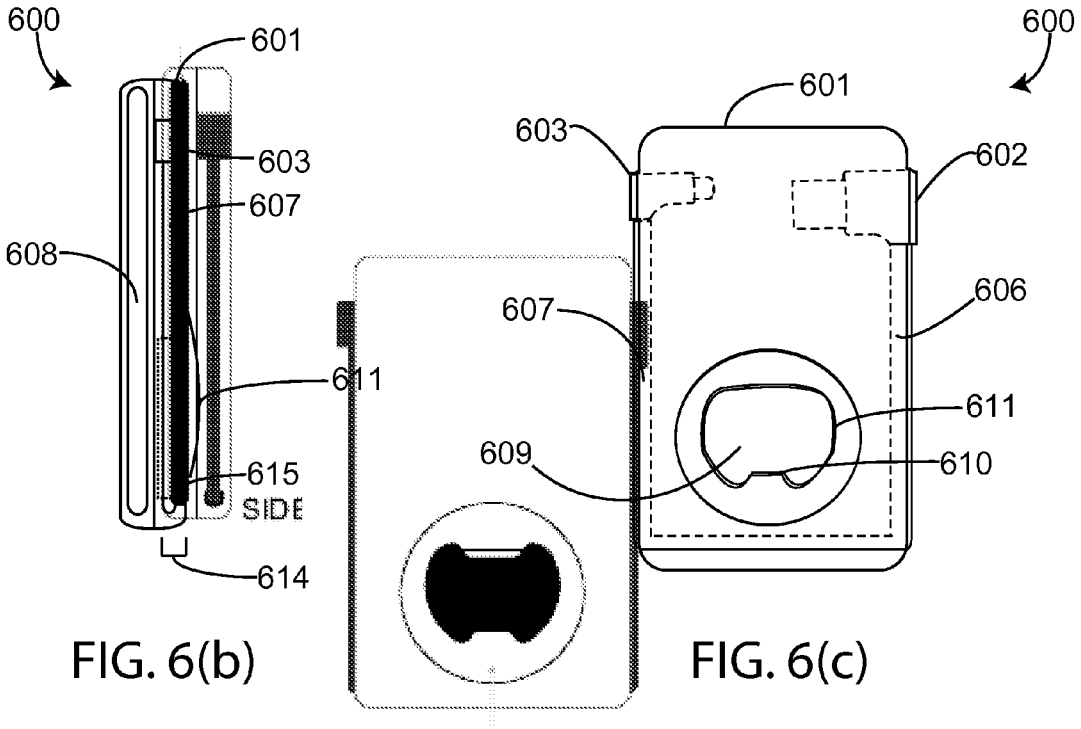
FIG. 6(b)
FIG. 6(c)

MOBILE DEVICE TRANSMISSION APPARATUS WITH INTEGRATED TOOL

PRIORITY NOTICE

The present application claims priority under 35 U.S.C. §119(e) to U.S. Provisional Patent Application Ser. No. 61/913,841 filed on Dec. 9, 2013, the disclosure of which is incorporated herein by reference in its entirety.

TECHNICAL FIELD OF THE INVENTION

The present invention relates to an apparatus for facilitating power transmission to and synchronization of a mobile device, which includes at least one integrated tool.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Mobile devices require electrical power to operate. Generally, mobile devices receive electrical power from the mobile device's own charged battery or via an outside source. Electrical power from an outside source is generally transmitted to a mobile device via a cable plugged into a wall electrical outlet and connected to the mobile device. Some wireless power transmission technologies are in development. Power transmitted to a mobile device from an outside source may be used to both charge the mobile device's battery and to independently operate the mobile device.

Additionally, it is often desirable for mobile devices to synchronize data and information between a mobile device and some other device, a host device, which itself may be another mobile device. Synchronization involves communication of data between two such devices, where the communication may be unidirectional or bidirectional. As with power transmission, synchronization is most readily accomplished via a cable, but wireless technologies may also be utilized.

Often the apparatus that facilitates power transmission to a mobile device and which facilitates synchronization of a mobile device is the same apparatus, e.g. a cable comprising wires and with appropriate connectors.

It would be convenient and thus useful to a user to combine an apparatus capable of facilitating power transmission to and synchronization of a mobile device with various integrated tools for accomplishing other functions independent of the power transmission and synchronization functions. Such combinations would eliminate a need for multiple separate apparatuses with only one function. The related art does not teach such combinations with respect to apparatuses for facilitating power transmission to and synchronization of mobile devices.

The related art does disclose universal serial bus (USB) apparatuses with various integrated tools where the tool's function is independent of any USB related functions. Examples of such tools in the related art include: keychains, bottle openers, writing implements, business card holders, and flashlights. For example, the related art teaches a bottle opener combined with a memory storage apparatus with a USB connector and a bottle opener combined with a wireless antenna apparatus with a USB connector. In another example, the related art teaches a writing implement (e.g. pen) combined with a memory storage apparatus with a USB connector. Also the related art teaches a business card holder combined with a memory storage apparatus with a USB connector.

However, the related art's disclosure of integrated tools with USB apparatuses has been limited to memory storage and wireless antenna apparatuses with a single USB connector. The current related art does not disclose apparatuses for transmitting power to a mobile device where the apparatus is integrated with another tool nor does the related art disclose apparatuses for mobile device synchronization with an integrated tool. Nor does the related art disclose mobile device transmission and synchronization apparatuses with such integrated tools, and also with two connectors, for connecting to two devices (e.g. a host device and a mobile device).

Instead the related art teaches transmitting power to a mobile device and/or mobile device synchronization being facilitated by a cable, with no integrated tools. Such a cable generally comprises a USB connection at one end and another connector at the other terminal end of the cable for various mobile devices (e.g. a Micro USB connection or a connection for Apple® devices like iPhones and iPads).

Other related art teaches transmitting power to a mobile device via a wireless technology (e.g. using magnetic fields) and accomplishing mobile device synchronization with a wireless technology (e.g. Bluetooth®), but in both wireless applications the related art does not teach any tools integrated into such apparatuses.

It would be useful and convenient to integrate the various tools note above with an apparatus for facilitating power transmission to and synchronization of a mobile device.

It is to these ends that the present invention has been developed.

BRIEF SUMMARY OF THE INVENTION

To minimize the limitations in the prior art, and to minimize other limitations that will be apparent upon reading and understanding the present specification, the present invention describes an apparatus for facilitating power transmission to and synchronization of a mobile device, which includes at least one integrated tool—for example, one or more of: a keychain, a bottle opener, a writing implement, and a business card holder.

An apparatus in accordance with one embodiment of the present invention, comprises: a first connector adapted to connect to a first device; a second connector, adapted to connect to a second device; a communication medium adapted for routing electrical signals between the first device and the second device; and a housing for securing the communication medium, wherein the housing further comprises a tool integrated with the housing.

An apparatus in accordance with another embodiment of the present invention, comprises: a first connector adapted to connect to a first device; a second connector, adapted to connect to a second device; a communication medium adapted for routing electrical signals between the first device and the second device; and a housing for securing the communication medium, wherein the housing further comprises a business card holder and a bottle opener integrated with the housing.

An apparatus in accordance with yet another embodiment of the present invention, comprises: a first connector adapted to connect to a first device; a second connector, adapted to connect to a second device; a communication medium adapted for routing electrical signals between the first device and the second device; and a housing for securing the communication medium, wherein the housing further comprises a bottle opener and a key-holder integrated with the housing.

It is an objective of the present invention to provide an apparatus that facilitates power transmission to and/or synchronization of a mobile device along with at least one integrated tool, where such integration is both useful and convenient for a user.

This and many other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 1(*b*) depicts an exemplary embodiment of an apparatus with an integrated keychain and an integrated bottle opener, in the process of opening a bottle, shown from a perspective view.

FIG. 2(*a*) depicts an exemplary embodiment of an apparatus with an integrated keychain and integrated bottle opener connected to two host devices (a laptop and a mobile device), shown from a perspective view.

FIG. 2(*b*) depicts an exemplary embodiment of an apparatus with an integrated keychain and integrated bottle opener connected to two host devices, shown from a perspective view.

FIG. 3(*b*) depicts an exemplary embodiment of an apparatus with an integrated keychain and integrated bottle opener, shown from a bottom view.

FIG. 3(*c*) depicts an exemplary embodiment of an apparatus with an integrated keychain and integrated bottle opener, shown from a front side view.

FIG. 3(*d*) depicts an exemplary embodiment of an apparatus with an integrated keychain and an integrated bottle opener, shown from a back side view.

FIG. 4(*b*) depicts an exemplary embodiment of an apparatus with an integrated keychain and integrated bottle opener, shown from a bottom view.

FIG. 5(*b*) depicts an exemplary embodiment of an apparatus with an integrated writing implement, shown from a side view with two caps removed.

FIG. 6(*a*) depicts an exemplary embodiment of an apparatus with an integrated business card holder and bottle opener, shown from a top view—the bottle opener is not depicted in this view.

FIG. 6(*b*) depicts an exemplary embodiment of an apparatus with an integrated business card holder and bottle opener, shown from a side view.

FIG. 6(*c*) depicts an exemplary embodiment of an apparatus with an integrated business card holder and bottle opener, shown from a bottom view.

DETAILED DESCRIPTION OF THE INVENTION

Figure 1A:
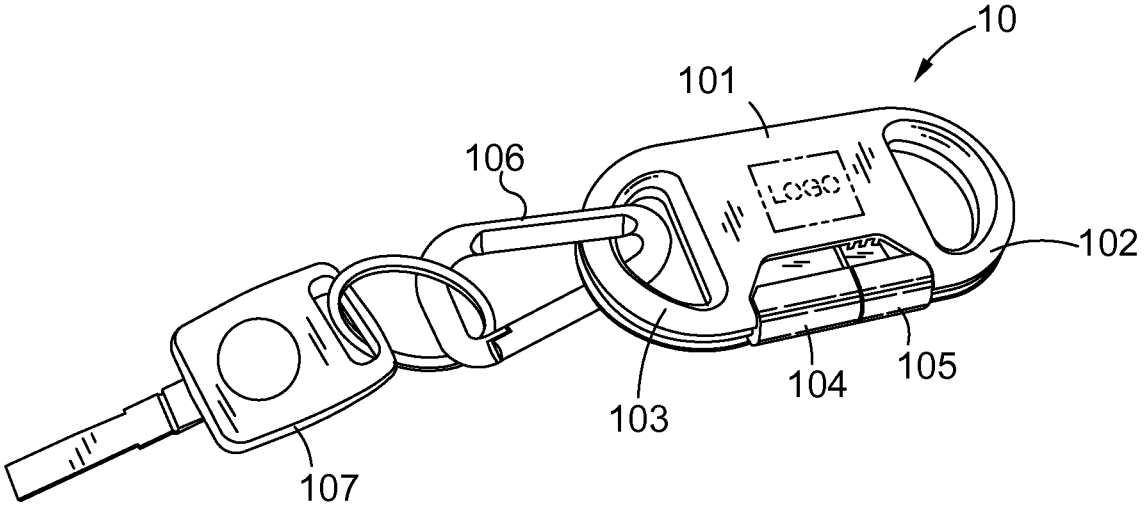
FIG. 1(*a*) depicts an exemplary embodiment of a power transmission and synchronization apparatus (hereinafter an "apparatus") with an integrated keychain on each end of the apparatus, holding a key, shown from a perspective view.

The present invention describes an apparatus for facilitating a transmission to a mobile device which includes at least one integrated tool of either a keychain, a bottle opener, both a keychain and a bottle opener, a writing implement, a business card holder, or both a business card holder and a bottle opener.

'Transmission' as used in this disclosure refers to either: power transmission, data transmission, or both power transmission and data transmission. Furthermore, transmission may occur in one of three directions: from a host device to a mobile device; from a mobile device to a host device; or in both directions between the host device and the mobile device. With respect to power transmission, the mobile device may receive power from the host device permitting operation of the mobile device regardless of the status of stored energy within the mobile device's battery. And the term, 'synchronization' as used in this disclosure refers to when data transmitted between the host device and the mobile device, i.e. the data transmission is bidirectional with respect to each device. Furthermore, 'synchronization' is within the scope of 'transmission' as used in this disclosure.

Without limiting the scope of the present invention, in several exemplary embodiments the apparatus with integrated tools may facilitate: only power transmission from the host device to the mobile device; only synchronization between the host device and the mobile device; or both power transmission from the host device to the mobile device along with synchronization between the host device and the mobile device. Other transmission configurations between the host device and mobile device are possible without departing from the scope of this invention.

In an exemplary embodiment, the apparatus for facilitating transmission between the host device and the mobile device may comprise: a communication medium adapted to facilitate the transmission between the host device and the mobile device; and a housing configured to secure the communication medium in desired conformations and where the housing further comprises an integrated tool; either a keychain, a bottle opener, both a keychain and a bottle opener, a writing implement, a business card holder, or both a business card holder and a bottle opener.

In an exemplary embodiment, transmission is facilitated via the communication medium permitting electrical power transmission and/or data synchronization between the host device and the mobile device. The communication medium may further comprise at least two connectors, a first connector and a second connector, where each connector is used to connect to the host device and the mobile device, respectively.

Furthermore, the first connector and the second connector may be in communication with each other to facilitate transmissions between the host device and the mobile device.

In an exemplary embodiment, the first connector may comprise a USB connector and the second connector may comprise a micro USB connector. In various embodiments, the communication medium with its connectors, such as USB connectors, whether micro or not, may be male or female and may be configured to facilitate USB 2.0 and/or USB 3 transfer protocols. In other embodiments, the communication medium, with its connectors, may be configured to facilitate other transmission protocols known by one with ordinary skill in the art.

In other exemplary embodiments, the first connector or second connector may comprise connectors permitting connection to an Apple® product, such as: MacBook®, iMac®, iPhone®, iPad®, or iPod®. Some Apple® products utilize a Thunderbolt® port and as such in some embodiments, the first connector or the second connector may be configured to connect to Thunderbolt® ports.

Examples of host devices may comprise: servers, desktop computers, laptops, memory storage devices, power supply devices, mobile devices, and the like. Examples of mobile devices may comprise: cell phones, smart phones, tablet devices, portable digital assistants (PDAs), wireless hotspot devices, portable batteries for charging other mobile devices, and the like. Note with respect to these examples of host devices and mobile devices provided in this paragraph, it is not desired nor intended to thereby unnecessarily limit the present invention by reason of such disclosure.

Furthermore, in an exemplary embodiment, the communication medium may further comprise a cable, with a length, which may be connected to the first connector and the second connector, such that the cable may be adapted to facilitate the transmission between the host device and the mobile device.

Additionally, the apparatus includes the ability to use at least one of the integrated tools of either a keychain, a bottle opener, both a keychain and a bottle opener, a writing implement, a business card holder, or both a business card holder and a bottle opener. Such tools may have a function which is independent of the apparatus's transmission capabilities. In some embodiments, while utilizing the integrated tools, the transmission capabilities may be protected from damage and also such tool use may not be obstructed by the transmission capabilities.

Additionally, in some exemplary embodiments use of the integrated tools and use of the transmission capabilities may not be mutually exclusive, i.e. both functions (e.g. transmission and tool use) of the apparatus may be utilized simultaneously. For example, while the apparatus is connected to the host device and to the mobile device, a bottle may be opened with the apparatus's integrated bottle opener.

While in other exemplary embodiments use of the integrated tools and use of the transmission capabilities may be mutually exclusive, i.e. both functions (e.g. transmission and tool) of the apparatus may not be utilized simultaneously.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

Figure 1B:
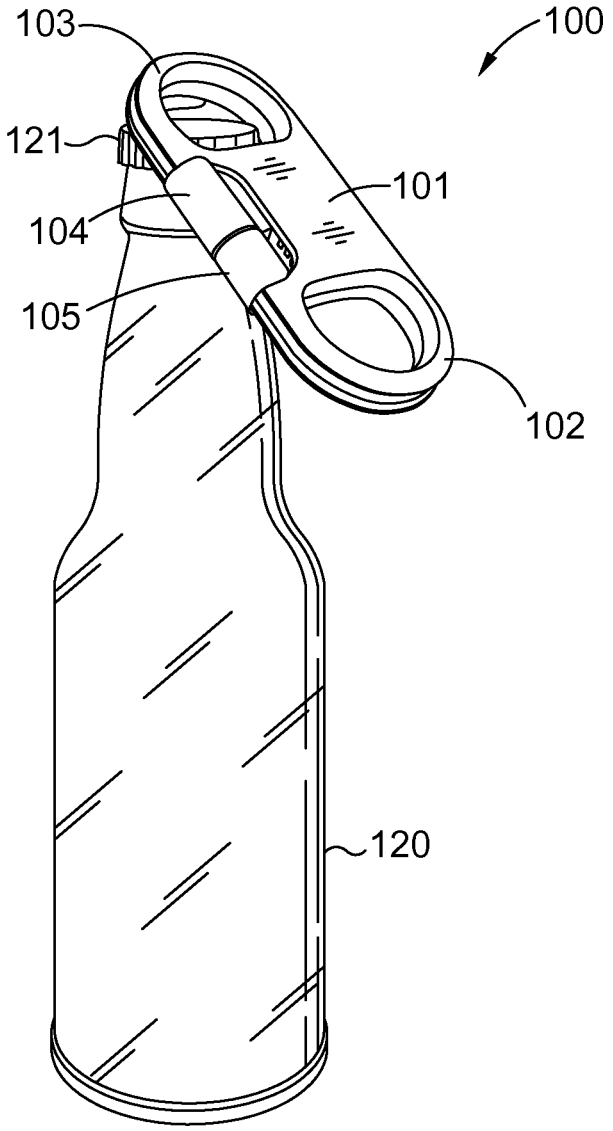
Figure 3A:
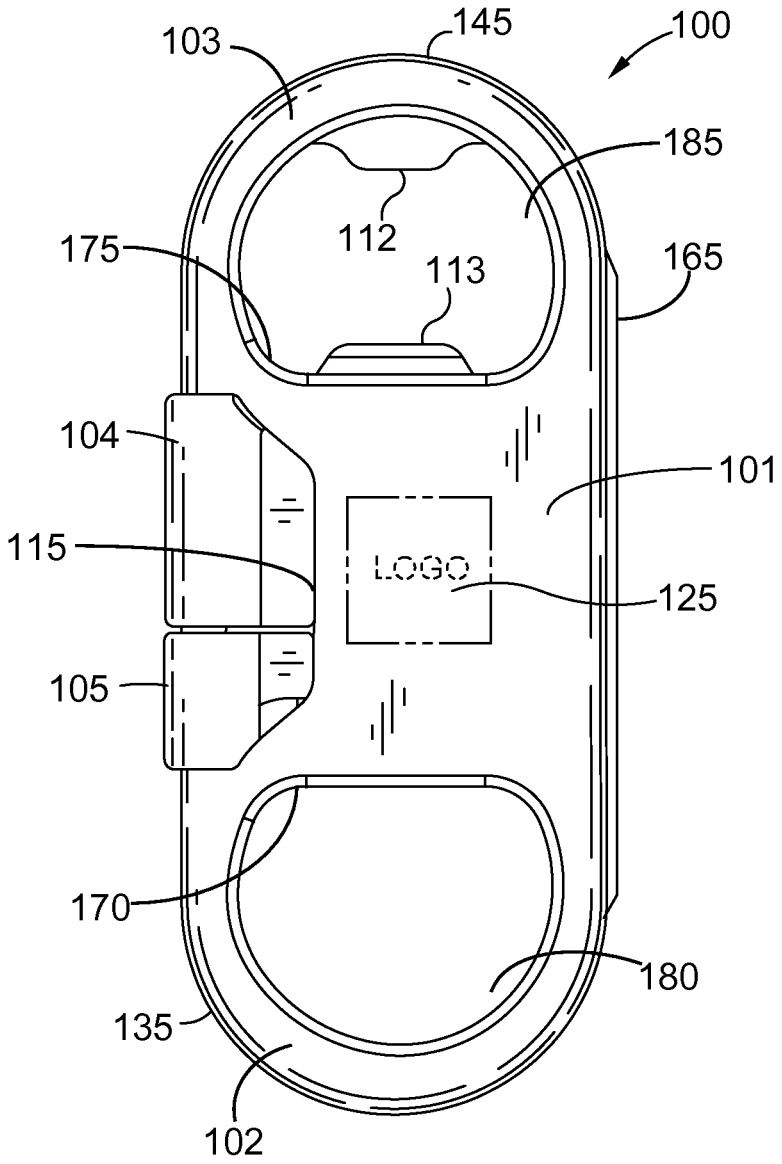
FIG. 3(*a*) depicts an exemplary embodiment of an apparatus with an integrated keychain and integrated bottle opener, shown from a top view.
Figure 3B:
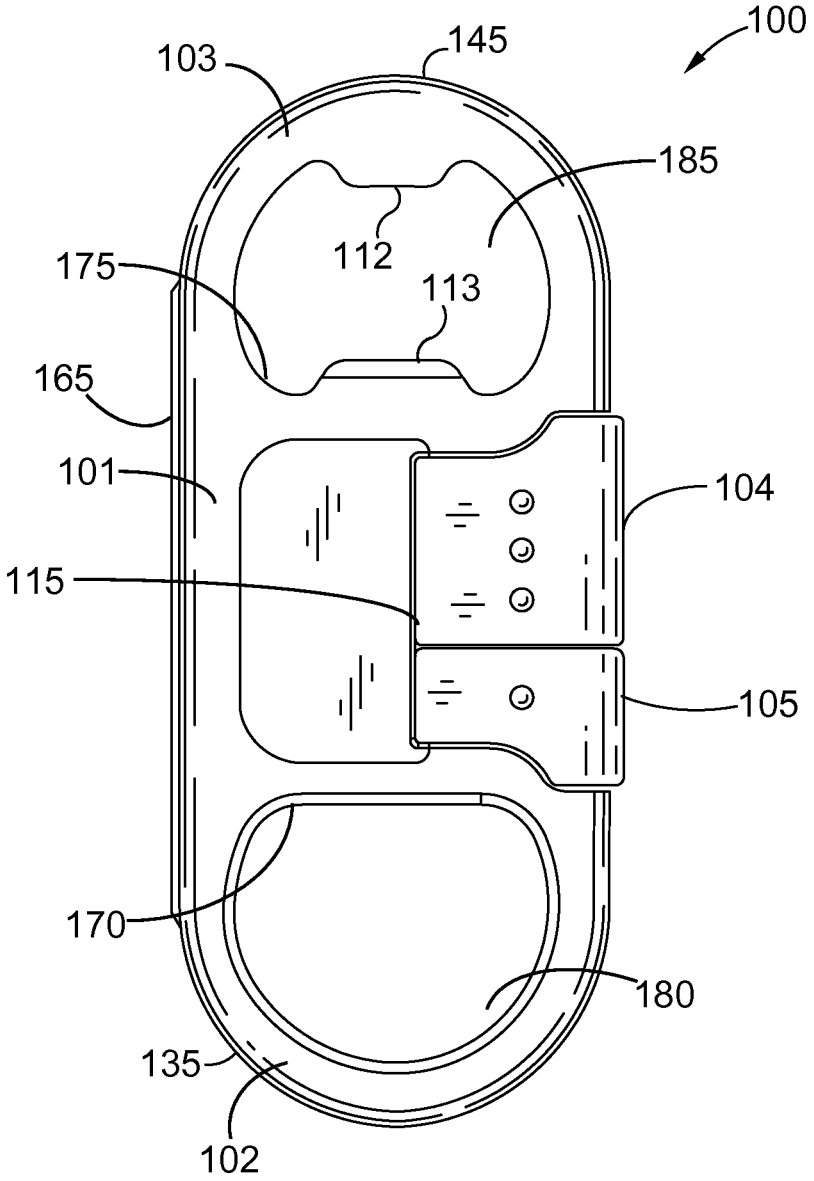
Figure 3C:
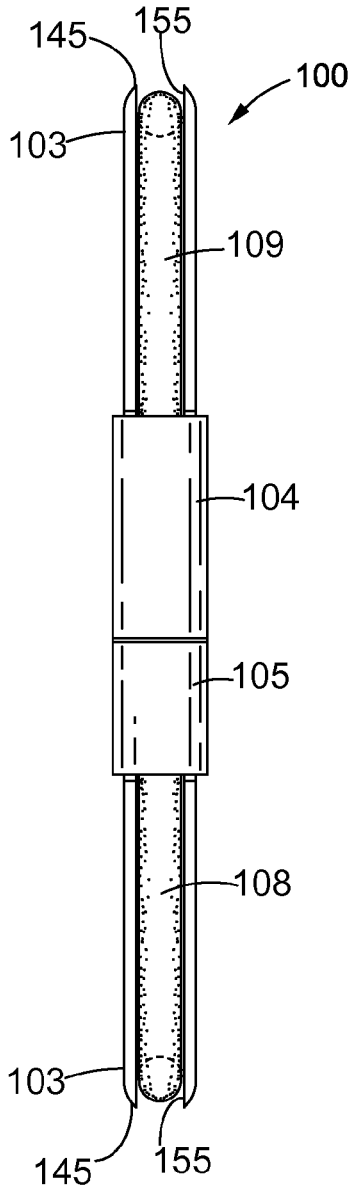
Figure 3D:
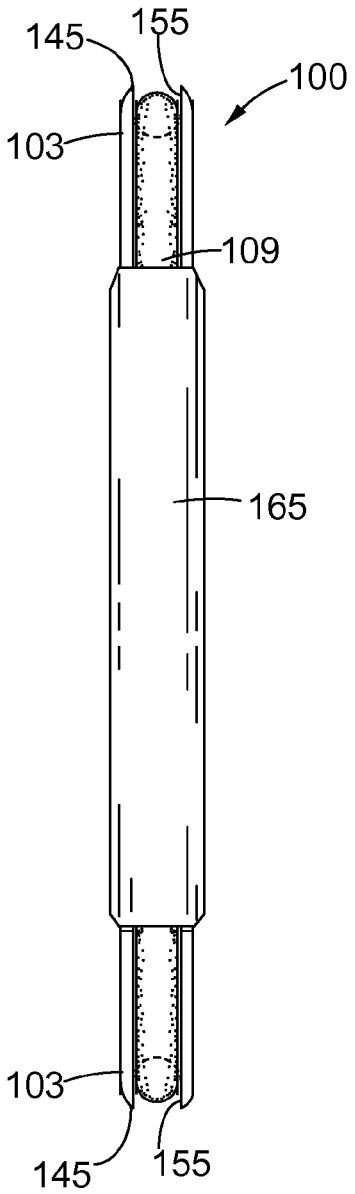

FIG. 1(*a*) depicts an exemplary embodiment of apparatus 10 with integrated keychain 102 on each end of apparatus 10, shown from a perspective view. One of the integrated keychains 102 is depicted holding key 107, via carabiner 106. A more detailed discussed of keychain 102, as well as housing 101, first connector 104 and second connector 105 are discussed below in the FIG. 3 and FIG. 4 series of figure's discussions.

FIG. 1(*b*) depicts an exemplary embodiment of apparatus 100 with integrated keychain 102 and integrated bottle opener 103, in the process of opening bottle 120, shown from a perspective view. The detailed features of bottle opener 103 are discussed below more fully in the FIG. 3 and FIG. 4 series of figures.

FIG. 2(*a*) depicts an exemplary embodiment of apparatus 100 with integrated keychain 102 and integrated bottle opener 103, connected to host device 111 and connected to mobile device 110, shown from a perspective view. First connector 104, a component of apparatus 100, connects with host device 111. Second connector 105, a component of apparatus 100, connects with mobile device 110.

In FIG. 2(*a*), first connector 104 may be a male USB connector. In other exemplary embodiment, first connector 104 may be a female USB connector. In further still exemplary embodiments, first connector 104 may be a connector for an Apple® product such as a: MacBook®, iMac®, iPhone®, iPad®, or iPod® (in either a male or female configuration). In further exemplary embodiments, first connector 104 may be a micro USB connector (male or female).

Similarly, in various exemplary embodiments, second connector 105 may be: a micro USB connector (male or female), an Apple® product connector (male or female), or a USB connector (male or female).

Further, first connector 104 and second connector 105 may be the same type or different type of connectors with respect to each other. For example, first connector 104 may be a male USB connector and second connector 105 may be male micro USB connector. Alternatively, first connector 104 and second connector 105 may both be male USB connectors. Other combinations of connector types for first connector 104 and second connector 105 are possible without deviating from the scope of the present invention.

With respect to host device 111 and mobile device 110, in FIG. 2(*a*) host device 111 is a laptop and mobile device 110 is a smartphone, such as an iPhone®. However and without limiting the scope of the present invention, host device 111 may be a: server, desktop computer, laptop, memory storage device, power supply device, or mobile device. Additionally and without limiting the scope of the present invention, mobile device 110 may be a: cell phone, smart phone, tablet device, portable digital assistant (PDA), wireless hotspot device, or portable device for charging batteries of other mobile devices.

Additionally, in FIG. 2(*a*) a communication medium such as a cable runs from first connector 104 to second connector 105 and facilitates transmission. This communication medium may be comprised of cable 108 and cable 109 as shown in FIGS. 3(*c*) and 3(*d*). One terminal end of cable 108 may connect to second connector 105. One terminal end of cable 109 may connect to first connector 104. The other remaining terminal end of each cable, 108 and 109, may terminate into the other respective cable. That is, one terminal end of cable 108 may terminate into one terminal end of cable 109, such that cable 108 and cable 109 may form a continuous cable. This cable (including cable 108 and cable 109), along with the first connector 104 and the second connector 105 may all comprise components of the communication medium.

FIG. 2(*b*) depicts an exemplary embodiment of apparatus 100 with integrated keychain 102 and integrated bottle opener 103 connected to host device 111 and connected to mobile device 110, shown from a perspective view. Host device 111 depicted in FIG. 2(*b*) may be a portable battery charging device. Mobile device 110 depicted in FIG. 2(*b*) is a smartphone, such as an Android® device. However, as noted above, host device 111 and mobile device 110 may be other appropriate devices without deviating from the scope of the present invention.

FIG. 3(*a*) depicts an exemplary embodiment of apparatus 100 with integrated keychain 102 and integrated bottle opener 103, shown from a top view. Apparatus 100 may comprise: a communication medium and housing 101.

The communication medium may be adapted to facilitate transmission between host device 111 and mobile device 110. Further, the communication medium may comprise first connector 104 and second connector 105, where first connector 104 may be configured to connect to host device 111 and second connector 105 is configured to connect to mobile device 110. Additionally, such transmission may be facilitated by first connector 104 and second connector 105 being in communication with each other. In various exemplary embodiments, such communication may be accomplished by wires or other electrical/optical connections running between first connector 104 and second connector 105.

In one exemplary embodiment, first connector 104 may be affixed to housing 101 such that housing 101 and first connector 104 are integral with each other.

Additionally, the communication medium may further comprise a cable, with a length and two terminal ends. One terminal end of the cable may connect to first connector 104 and the remaining terminal end of the cable may connect to second connector 105. Wires or other electrical/optical connections may run within the cable, connecting first connector 104 to second connector 105.

Figure 4A:
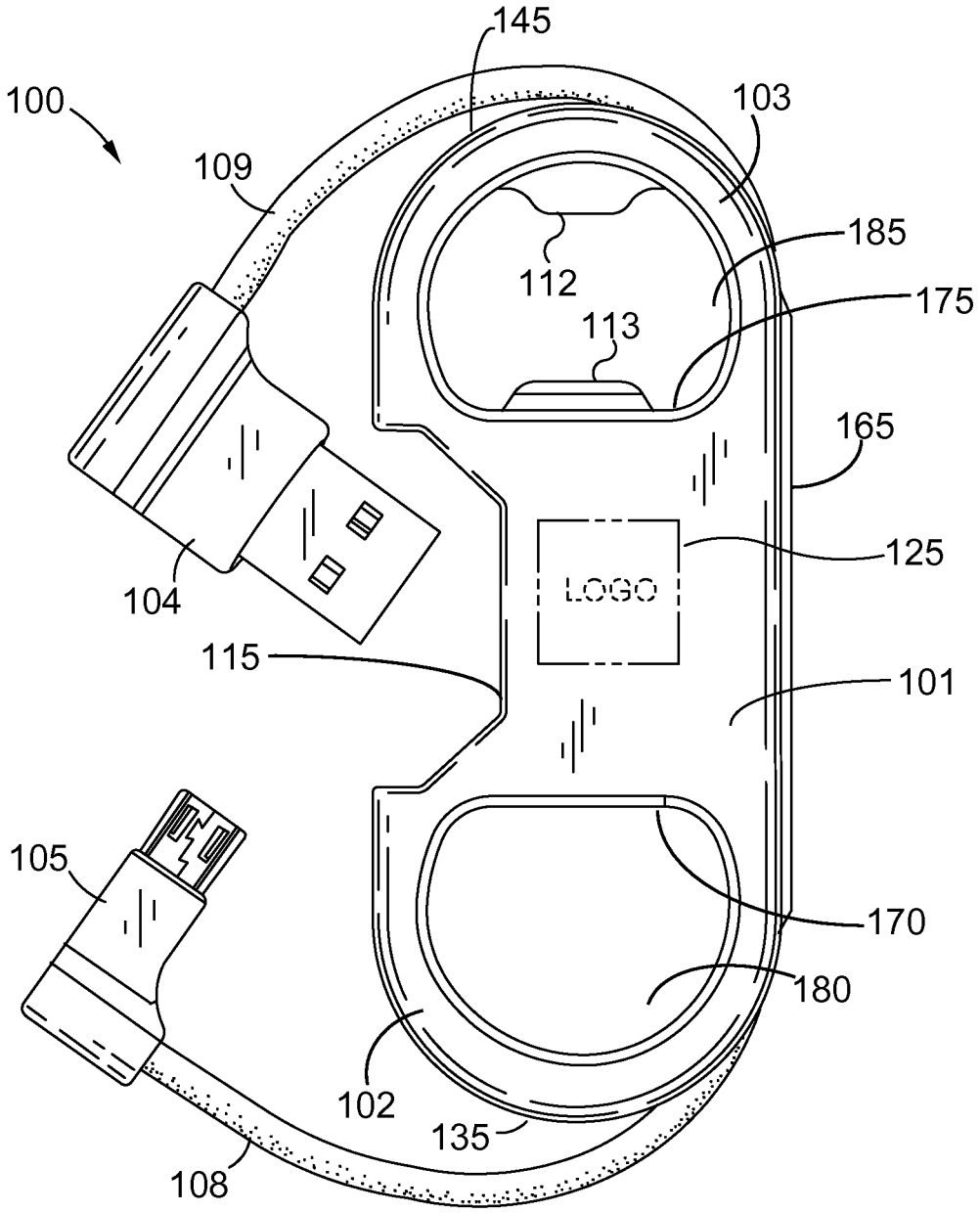
FIG. 4(*a*) depicts an exemplary embodiment of an apparatus with an integrated keychain and integrated bottle opener, shown from a top view.
Figure 4B:
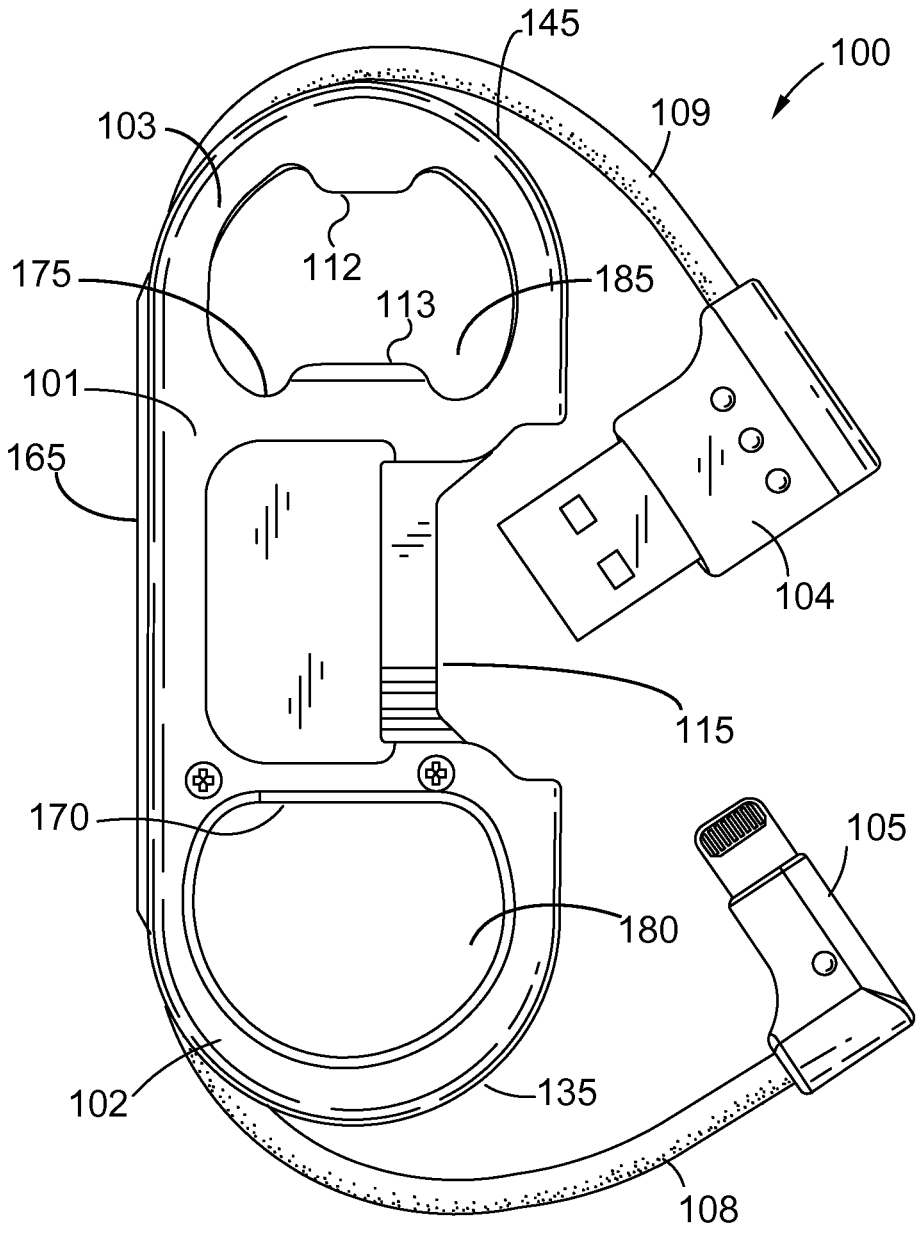

Housing 101 may comprise first terminal end 170, second terminal end 175, integrated keychain 102, integrated bottle opener 103, cable groove 155 (not depicted in FIG. 3(*a*), see FIG. 4(*c*)), cable holder 165, receptacle 115, and indicator 125. Each of these housing 101 elements is discussed below.

First terminal end 170 and second terminal end 175 may be located on longitudinal opposite ends of housing 101. First terminal end 170 and keychain 102 form a region which may be configured to hold keys and key-rings. While second terminal end 175 and bottle opener 103 form a region which may be configured to remove bottle caps from bottles.

Integrated keychain 102 may comprise first closed arch 135 which may be adapted to accept keys and key-rings by such keys and/or key-rings circumscribing first closed arch 135. The plane of the first closed arch 135 may be in the same plane as housing 101. First closed arch 135 may be formed by extending an arched protrusion from first terminal end 170 of housing 101, such that first closed aperture 180 is formed. The point of extension between first closed arch 135 and housing 101 may be completely integrated, i.e. seamless. In an exemplary embodiment, first closed arch 135 and housing 101 may be manufactured as a single integral member, e.g. molded as a single member of plastic or machined from a single piece of metal. First closed arch 135 and first terminal end 170 of housing 101 may circumscribe first closed aperture 180.

Integrated bottle opener 103 may be comprise second closed arch 145, outer flange 112, and inner flange 113; which together with second terminal end 175 of housing 101 permit bottle caps to be removed from bottles. The plane of the second closed arch 145 may be in the same plane as housing 101. Second closed arch 145 may be formed by extending an arched protrusion from second terminal end 175 of housing 101, such that second closed aperture 185 is formed. The point of extension between second closed arch 145 and housing 101 may be completely integrated, i.e. seamless. In an exemplary embodiment, second closed arch 145 and housing 101 may be manufactured as a single integral member, e.g. molded as a single member of plastic or machined from a single piece of metal. Second closed arch 145 and second terminal end 175 of housing 101 may circumscribe second closed aperture 185 where outer flange 112 and inner flange 113 both protrude into second closed aperture 185.

Second closed aperture 185 created by second closed arch 145 and second terminal end 175 of housing 101 may be sized to accommodate the top of bottles with bottle caps. Outer flange 112 and inner flange 113 may be sized and positioned to a remove bottle from a bottle, by allowing opposing forces to be applied from each of these two flanges to opposing surfaces of the bottle cap. For example, one of the flanges may be used to generate a lifting force, while the remaining flange may operate as a fulcrum. Furthermore, either or both flanges may frictionally engage the bottle cap. Outer flange 112 may partially protrude inwards towards second closed aperture 185 from an inner radius of second closed arch 145. Inner flange 113 also may partially protrude inwards towards second closed aperture 185, but originates from second terminal end 175 of housing 101.

In other exemplary embodiments, the integrated bottle opener may comprise a large tab extending from housing 101; and a lifting tab extending from housing 101 in a spaced relation to said large tab; wherein the large tab and lifting tab operate to engage a bottle cap by allowing opposing forces to be applied from each of the two tabs to opposing surfaces of the bottle cap resulting in removal of the bottle cap from the bottle. The spaced relation may be sized to accommodate the depth of the bottle cap, such that the lifting tab may generate a lifting force onto the bottle cap, while the bottle cap presses against the large tab, which acts as a fulcrum. In such an exemplary embodiment, the large tab and lifting tab may both extend from the same terminal end of housing 101.

Note, in various other exemplary embodiments the apparatus may have only integrated keychain 102, with either one or two keychains (such as FIG. 1(*a*)); or only integrated bottle opener 103.

As noted above, housing 101 and second closed arch 145, as well as first closed arch 135, in some exemplary embodiments may be of the same material, e.g. plastic or metal. In an exemplary embodiment, outer flange 112 and inner flange 113 may be metal. In those embodiments where housing 101, first closed arch 135 and second closed arch 145 are a single molded plastic member, outer flange 112 and inner flange 113 may be integrated into apparatus 100 as metal inserts during the molding process.

In other embodiments, outer flange 112 and inner flange 113 may be plastic with suitable properties for removing metal bottle caps from bottles. Such properties may be created by using a glass filled plastic to increase tensile strength or by adding structural geometry to the flanges, such as ribs.

Cable groove 155, a component of housing 101, may be configured to accommodate a resting location for cable 108 and cable 109. Note, cable groove 155 is better depicted in FIG. 3(*c*). Cable groove 155 runs substantially along an outer edge of housing 101, including along the outer edge of first closed arch 135 and along the outer edge of second closed arch 145. The length of cable groove 155 may be interrupted by the region of receptacle 115. A portion of cable groove 155 may be covered or partially covered by cable holder 165, which is discussed next.

In an exemplary embodiment, cable holder 165, a component of housing 101, may securely hold a portion of cable 108 and cable 109 in cable groove 155, in a manner where that portion of cable 108 and cable 109 may not be separated from housing 101 along the length of cable holder 165. Cable holder 165 may be located upon a portion of the outside edge of housing 101, on the opposite edge from receptacle 115, and may run longitudinally along the length of housing 101 from the beginning of first closed arch 135 to the beginning of second closed arch 145. Cable holder 165 may operate by partially or totally covering a length of cable 108 and cable 109 along the length of cable holder 165, as cable 108 and cable 109 resides in cable groove 155.

In other exemplary embodiments, not depicted, there may be a plurality of cable holders. Additionally in still further embodiments, not depicted, cable holder 165 may comprise a snap or a plurality of snaps, such that the cables may be removably coupled to cable holder 165.

Receptacle 115, a component of housing 101, as shown in FIG. 3(*a*), provides a receptacle for removably storing first connector 104 and second connector 105. Receptacle 115 is sized such that both first connector 104 and second connector 105, while stored, may be held frictionally in place within a cavity of receptacle 115. The geometry of receptacle 115 may be such that first connector 104 and second connector 105 may be snapped into and out of receptacle 115. First connector 104 and second connector 105 may be removably coupled to receptacle 115.

In other exemplary embodiments, receptacle 115 may comprise two receptacles, with one receptacle for each of the two connectors. In such embodiments, there may be a first receptacle for removably storing first connector 104 and a second receptacle for removably storing second connector 105. Additionally, in further exemplary embodiments such a first receptacle and a second receptacle may be located adjacent to each other in housing 101 or located at different locations on housing 101.

Furthermore, housing 101 may comprise indicator 125. Indicator 125 may be a region located on the top of housing 101 which is configured to display desired logos, trademarks, or other graphics. Without limiting the scope of the present invention such an indicator may be applied to housing 101 via print, sticker, engraved, or molded into the upper surface of housing 101, either as an indentation or a raised protrusion.

FIG. 3(*b*) depicts an exemplary embodiment of apparatus 100 with integrated keychain 102 and bottle opener 103, shown from a bottom view. The bottom of housing 101, receptacle 115, connectors 104 and 105, outer flange 112, and inner flange 113 are also all depicted in FIG. 3(*b*) and were all discussed above under the FIG. 3(*a*) discussion.

FIG. 3(*c*) depicts an exemplary embodiment of apparatus 100 with integrated keychain 102 and bottle opener 103, shown from a front side view. Here, cable 108 and cable 109 are shown residing in cable groove 155.

FIG. 3(*d*) depicts an exemplary embodiment of apparatus 100 with integrated keychain 102 and bottle opener 103, shown from a back side view. In the depicted exemplary embodiment, cable holder 165 is depicted as totaling covering cable 108 and cable 109, while the cable resides in cable groove 155, and along the length of cable holder 165. In other embodiments, not shown, cable holder 165 may only partially cover cable 108 and cable 109 along the length of cable holder 165, such that a slot rung along the longitudinal length of cable holder 165. As noted above under the FIG. 3(*a*) discussion, cable holder 165 may be a component of housing 101 and may function to securely hold a portion of the cable to housing 101 that is less than the length of the cable.

FIG. 4(*a*) depicts an exemplary embodiment of apparatus 100 with integrated keychain 102 and integrated bottle opener 103, shown from a top view, while first connector 104 and second connector 105 are removably uncoupled from receptacle 115. While in this configuration these two connectors may be connected to host device 111 and the mobile device 110 as discussed above in the FIG. 2 discussions. Additionally, as depicted in FIG. 4(*a*), cable 108 may removably come out of cable groove 155 along first closed arch 135 and cable 109 may removably come out of cable groove 155 along second closed arch 145, but the cable (cable 108 and cable 109) may otherwise still held secured to housing 101 in the remaining balance of cable groove 155 by cable holder 165.

FIG. 4(*b*) depicts an exemplary embodiment of apparatus 100 with integrated keychain 102 and integrated bottle opener 103, shown from a bottom view.

Figure 5A:
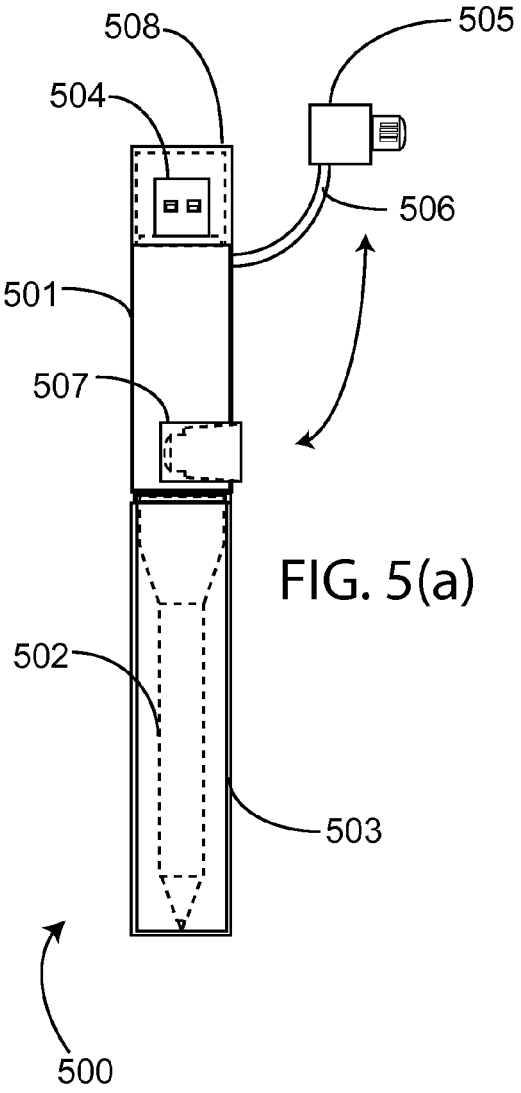
FIG. 5(*a*) depicts an exemplary embodiment of an apparatus with an integrated writing implement, shown from a side view.
Figure 5B:
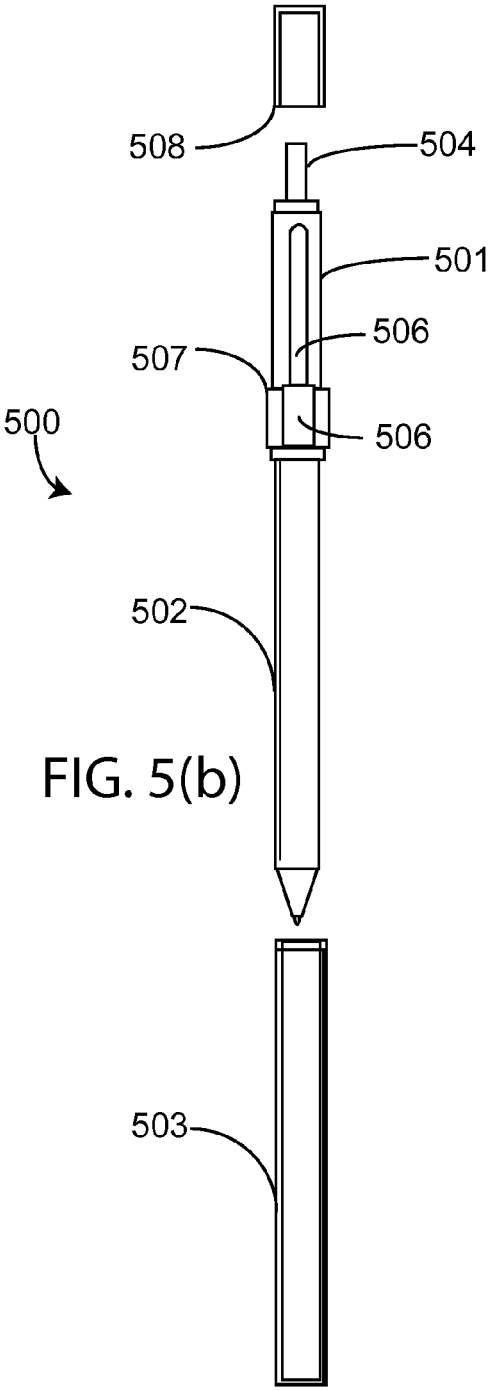

FIG. 5(*a*) depicts an exemplary embodiment of apparatus 500 with integrated writing implement 502, shown from a side view. Writing implement 502 may comprise various writing and drafting implements such as, and without limiting the scope of the present invention, pens, pencils, markers, and highlighters.

Apparatus 500 may comprise a communication medium and housing 501. The communication medium may be adapted to facilitate transmission between host device 111 and mobile device 110. Further, the communication medium may comprise first connector 504 and second connector 505, where first connector 504 may be configured to connect to host device 111 and second connector 505 may be configured to connect to mobile device 110. Additionally, such transmission may be facilitated by first connector 504 and second connector 505 being in communication with each other. In various exemplary embodiments, such communication may be accomplished by wires or other electrical/optical connections running between first connector 504 and second connector 505.

In one exemplary embodiment, first connector 504 may be affixed to housing 501 at first terminal end 509 such that housing 501 and first connector 504 are integral with each other.

Additionally, the communication medium may further comprise a cable, with a length and two terminal ends. One terminal end of the cable may connect to first connector 504 and the remaining terminal end of the cable may connect to second connector 505. Wires or other electrical/optical connections may run within the cable, connecting first connector 504 to second connector 505.

Housing 501 may comprise first terminal end 509, second terminal end 510, integrated writing implement 502, cable groove 512, cable holder 511, receptacle 507, and indicator 513. Each of these housing 501 elements is discussed below.

First terminal end 509 and second terminal end 510 may be located on longitudinal opposite ends of housing 501. First connector 504 may extend from first terminal end 509 and writing implement 502 may extend from second terminal end 510, where both extensions may be in a longitudinal direction with respect to apparatus 500.

Cable groove 512, a component of housing 501, may be configured to accommodate a resting location for cable 506 for when second connector 505 is not in use. Cable groove 512 may run along an outer surface of housing 501 in a longitudinal direction from cable holder 511 to receptacle 507.

In an exemplary embodiment, cable holder 511, a component of housing 501, may securely hold a portion of cable 506 in cable groove 512, by affixing a terminal end of cable 506 to housing 501.

Receptacle 507, a component of housing 501, as shown in FIG. 5(*a*), provides a receptacle for removably storing second connector 505. Receptacle 507 is sized such that second connector 505, while stored, may be held frictionally in place within a cavity of receptacle 507. The geometry of receptacle 507 may be such that second connector 505 may be snapped into and out of receptacle 507. Second connector 505 may be removably coupled to receptacle 507.

Furthermore, housing 501 may comprise indicator 513. Indicator 513 may be a region located on an outer surface of housing 101 which is configured to display desired logos, trademarks, or other graphics. Without limiting the scope of the present invention such 513 may be applied to housing 501 via print, sticker, engraved, or molded into the upper surface of housing 101, either as an indentation or a raised protrusion.

FIG. 5(*b*) depicts an exemplary embodiment of apparatus 500 with integrated writing implement 502, shown from a side view with cap writing implement cap 503 and first connector cap 508 removably uncoupled from writing implement 502 and first connector 504, respectively. Note, the side view depicted in FIG. 5(*b*) is rotated 90 degrees along apparatus's 500 longitudinal length from the side view depicted in FIG. 5(*a*). Writing implement cap 503 may be sized to removably couple to housing 501 at second terminal end 510, such that writing implement 502 may be covered and protected when writing implement 502 is not in use. The manner of removable coupling may be by a frictional grip or snap configuration. Likewise, first connector cap 508 may be sized to removably couple to housing 501 at first terminal end 509, such that first connector 504 may be covered and protected when first connector 504 is not in use. And the manner of removable coupling may be by a frictional grip or snap configuration.

FIG. 6(*a*) depicts an exemplary embodiment of apparatus 600 with integrated business card holder and bottle opener, shown from a top view. Note, the integrated bottle opener is not depicted in this view. In other exemplary embodiments the integrated bottle opener may be absent.

FIG. 6(*b*) depicts an exemplary embodiment of apparatus 600 with an integrated business card holder and bottle opener, shown from a side view. Note, the bottle opener is not depicted in this view.

FIG. 6(*c*) depicts an exemplary embodiment of apparatus 600 with an integrated business card holder and bottle opener, shown from a bottom view.

With respect to the FIG. 6 series of figures, apparatus 600 may comprise a communication medium and housing 601. The communication medium may be adapted to facilitate transmission between host device 111 and mobile device 110. Further, the communication medium may comprise first connector 602 and second connector 603, where first connector 602 may be configured to connect to host device 111 and second connector 603 is configured to connect to mobile device 110. Additionally, such transmission may be facilitated by first connector 602 and second connector 603 being in communication with each other. In various exemplary embodiments, such communication may be accomplished by wires or other electrical/optical connections running between first connector 602 and second connector 603.

In one exemplary embodiment, first connector 602 may be affixed to housing 601 such that housing 601 and first connector 602 are integral with each other.

Additionally, the communication medium may further comprise a cable, with a length and two terminal ends. One terminal end of the cable may connect to first connector 602 and the remaining terminal end of the cable may connect to second connector 603. Wires or other electrical/optical connections may run within the cable, connecting first connector 602 to second connector 603.

Housing 601 may comprise an integrated business card holder, an integrated bottle opener, cable groove 616, cable holder 617, first receptacle 604, second receptacle 605, and indicator 620. Each of these housing 601 elements is discussed below.

The integrated business card holder may comprise first cavity 608 within housing 601 wherein first cavity 608 is closed at first closed end 612 of first cavity 608 and open at second open end 613 of first cavity 608, such that first cavity 608 may be adapted to removably store business cards within first cavity 608. First cavity 608 may generally have a rectangular prism cavity to accommodate storage of business cards within first cavity 608. Such business cards may be inserted and removed from first cavity 608 via second open end 613. Second open end 613 may generally have a slot shape to accommodate insertion and removal of business cards into first cavity 608.

The integrated bottle opener may comprise second cavity 609 with circumference 611, depth 614, and second closed end 615 such that circumference 611 and depth 614 of second cavity 609 are configured to permit a bottle cap into second cavity 609. Additionally, the integrated bottle opener may further comprise flange 610 which may partially protrude into second cavity 609 from an edge of circumference 611 of second cavity 609. Flange 610 and second closed end 615 of second cavity 609 may operate to engage a bottle cap by allowing opposing forces to be applied from flange 610 and second closed end 615 to opposing surfaces of the bottle cap resulting in removal of the bottle cap from bottle 120. That is, when bottle 120 with a bottle cap is inserted into second cavity 609, flange 610 may exert a lifting force upon the bottle cap and second closed end 615 may act as fulcrum upon a top surface of the bottle cap, resulting in removal of the bottle cap from bottle 120.

Note in some exemplary embodiments, the integrated bottle opener of apparatus 600 may be absent.

Cable groove 616, a component of housing 601, may be configured to accommodate a resting location for cable 606 and cable 607. Also note, cable 606 and cable 607 may comprise a single continuous cable. Cable groove 616 runs substantially along an outer edge of housing 601, including through cable holder 617. The length of cable groove 616 may be interrupted by the regions of first receptacle 604 and of second receptacle 605. A portion of cable groove 616 may be covered or partially covered by cable holder 617, which is discussed next.

In an exemplary embodiment, cable holder 617, a component of housing 601, may securely hold a portion of cable 606 and cable 607 in cable groove 616, such that the cables may not be entirely removed from housing 601. Cable holder 617 may operate by partially or totally covering a length of cable 606 and cable 607 along the length of cable holder 617, as cable 606 and cable 607 resides in cable groove 616. Cable holder 617 may be located along a portion of the outside edge of housing 601, on an edge which is different from the edges where first receptacle 604 and second receptacle 605 are located.

In other exemplary embodiments, not depicted, there may be a plurality of cable holders. Additionally in still further embodiments, not depicted, cable holder 617 may comprise a snap or a plurality of snaps, such that the cables may be removably coupled to cable holder 617.

Two receptacles, first receptacle 604 and second receptacle 605, may also be components of housing 601. Such receptacles may be adapted to removably couple each respective connector, such that when the connectors are not in use they may be stored in the respective receptacle. For instance, in various exemplary embodiments, first receptacle 604 is sized such that first connector 602, while stored, may be held frictionally in place within a cavity of first receptacle 604. The geometry of first receptacle 604 may be such that first connector 602 may be snapped into and out of first receptacle 604.

Likewise, in various exemplary embodiments, second receptacle 605 is sized such that second connector 603, while stored, may be held frictionally in place within a cavity of second receptacle 605. The geometry of second receptacle 605 may be such that second connector 603 may be snapped into and out of second receptacle 605.

In other exemplary embodiments, first receptacle 604 and second receptacle 605 may comprise a single receptacle, with one receptacle to accommodate both connectors. In such embodiments, the purpose and function of such a single receptacle may be the same as for the embodiments with two separate receptacles.

Furthermore, housing 601 may also comprise indicator 620. Indicator 620 may be a region located on the top of housing 601 which is configured to display desired logos, trademarks, or other graphics. Without limiting the scope of the present invention such indicator 620 may be applied to housing 601 via print, sticker, engraved, or molded into the upper surface of housing 601, either as an indentation or a raised protrusion.

An apparatus for facilitating the transmission to the mobile device which includes at least one integrated tool of either a keychain, a bottle opener, both a keychain and a bottle opener, a writing implement, a business card holder, or both a business card holder and a bottle opener, has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An apparatus, comprising:
- a first connector adapted to connect to a first device;
- a second connector, adapted to connect to a second device;
- a cable adapted for routing electrical signals between the first device and the second device; and
- a housing for securing the cable, the first connector, and the second connector, comprising:
  - a body with first and second terminal ends situated on longitudinal opposite ends of the body, and first and second sides situated adjacent to said first and second terminal ends;
  - first and second arched protrusions extending from the first and second terminal ends respectively and situated on the same plane;
  - a channel running along an outer perimetrical edge of the housing, including the outer edge of the first and second arched protrusions, the channel for securing the cable to the housing;
  - a cable holder on the second side of the housing; and
  - a receptacle on the first side of the housing for securing the first and second connectors to the body of the housing.

2. The apparatus of claim 1, wherein the first arched protrusion comprises an aperture configured to hold keys and key-rings.

3. The apparatus of claim 1, wherein the first arched protrusion comprises an aperture including:
- an inner flange which partially protrudes into the aperture from the first terminal end of the housing; and
- an outer flange which partially protrudes into the aperture from the first arched protrusion extending from the first terminal end of the housing, wherein the inner flange and outer flange are configured to engage a bottle cap.

4. An apparatus, comprising:
- a first connector adapted to connect to a first device;
- a second connector, adapted to connect to a second device;
- a cable adapted for routing electrical signals between the first device and the second device; and
- a housing for securing the cable, the first connector, and the second connector, comprising:
  - a substantially rectangular prism body, including a front flat surface and a back flat surface;
  - a substantially rectangular prism cavity situated directly beneath the front flat surface of the body;
  - a channel running along an internal perimetrical edge of the housing, including the internal edge of the rectangular prism body, the channel for securing the cable to the housing; and
  - a receptacle for securing the first and second connectors to the body of the housing.

5. The apparatus of claim 4, wherein the cavity is closed at a first end of the cavity and open at a second end of the cavity, such that the cavity is adapted to removably store business cards within the cavity where entry to the cavity is through the second end of the cavity.

6. The apparatus of claim 4, further comprising:
- an aperture situated on the front or back surface, adapted such that a circumference of the aperture is configured to permit a bottle cap into the aperture;
- an inner flange which partially protrudes into the aperture from a terminal end of the housing; and
- an outer flange which partially protrudes into the aperture, wherein the inner flange and outer flange operate to engage the bottle cap by allowing opposing forces to be applied from each flange to opposing surfaces of the bottle cap resulting in removal of the bottle cap from a bottle.

7. An apparatus, comprising:
- a first connector adapted to connect to a first device;
- a second connector, adapted to connect to a second device;
- a cable adapted for routing electrical signals between the first device and the second device; and
- a housing for securing the cable comprising:
  - a body with first and second terminal ends situated on longitudinal opposite ends of the body, wherein the first terminal end includes the first connector and the second terminal end includes a writing implement;
  - a receptacle situated on the body between the first and second terminal ends for securing the second connector to the body of the housing.

* * * * *